US011854464B2

(12) United States Patent
Li

(10) Patent No.: US 11,854,464 B2
(45) Date of Patent: Dec. 26, 2023

(54) DISPLAY DEVICE AND LIGHT-EMITTING PANEL

(71) Applicant: TCL China Star Optoelectronics Technology Co., Ltd., Guangdong (CN)

(72) Inventor: Yan Li, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 361 days.

(21) Appl. No.: 16/973,447

(22) PCT Filed: Nov. 27, 2020

(86) PCT No.: PCT/CN2020/132190

§ 371 (c)(1),
(2) Date: Dec. 9, 2020

(87) PCT Pub. No.: WO2022/095166

PCT Pub. Date: May 12, 2022

(65) Prior Publication Data

US 2022/0319395 A1 Oct. 6, 2022

(30) Foreign Application Priority Data

Nov. 5, 2020 (CN) ..... 202011222211.1

(51) Int. Cl.
*G09G 3/32* (2016.01)
*G09G 3/34* (2006.01)

(52) U.S. Cl.
CPC ..... *G09G 3/32* (2013.01); *G09G 3/3426* (2013.01); *G09G 2320/0233* (2013.01); *G09G 2330/021* (2013.01)

(58) Field of Classification Search
None
See application file for complete search history.

(56) References Cited

U.S. PATENT DOCUMENTS 6,859,193 B1 * 2/2005 Yumoto ..... G09G 3/3216 345/82
7,432,889 B2 * 10/2008 Yumoto ..... G09G 3/3283 315/169.3
8,044,893 B2 * 10/2011 Nathan ..... G09G 5/00 345/82

(Continued)

FOREIGN PATENT DOCUMENTS

CN 202275588 6/2012
CN 103646629 3/2014

(Continued)

*Primary Examiner* — Fred Tzeng

(57) ABSTRACT

The present disclosure provides a display device and a light-emitting panel. The light-emitting panel includes a plurality of minimal repeating units, the minimal repeating units include a driving chip and a light emitting device, and the driving chip and the light emitting device are electrically connected, wherein the driving chip includes a first driving submodule, a second driving submodule, and a capacitor, and the light emitting device includes a first light emitting device and a second light emitting device. The first driving submodule is electrically connected to a first end of the first light emitting device, and the second driving submodule is electrically connected to a first end of the second light emitting device.

20 Claims, 5 Drawing Sheets

(56) References Cited

U.S. PATENT DOCUMENTS

2005/0140599 A1* 6/2005 Lee ..... G09G 3/3233 345/76
2005/0212444 A1* 9/2005 Lee ..... G09G 3/3233 315/169.3
2006/0176250 A1* 8/2006 Nathan ..... G09G 3/3233 345/76
2006/0238468 A1* 10/2006 Ishikura ..... G09G 3/3266 345/83
2007/0075939 A1* 4/2007 Cho ..... H01L 27/32 345/76
2007/0205999 A1* 9/2007 Akimoto ..... G06F 3/0412 345/207
2007/0296671 A1* 12/2007 Han ..... G09G 3/3233 345/92
2009/0230392 A1* 9/2009 Takahara ..... H01L 27/1225 438/34
2010/0156880 A1* 6/2010 Lee ..... G09G 3/3233 345/213
2011/0012883 A1* 1/2011 Nathan ..... G09G 3/3696 345/211
2012/0188293 A1* 7/2012 Furukawa ..... H05B 45/382 315/210
2012/0249510 A1* 10/2012 Jankovic ..... G09G 3/3233 345/211
2013/0063036 A1 3/2013 Li
2013/0265215 A1* 10/2013 Liao ..... G09G 3/3233 345/82
2016/0307503 A1* 10/2016 Song ..... G09G 3/3233
2017/0045972 A1* 2/2017 Xu ..... H01L 27/3211
2017/0249900 A1* 8/2017 Xiang ..... G09G 3/3291
2019/0019456 A1* 1/2019 Chen ..... G09G 3/3258
2020/0395575 A1* 12/2020 Maeda ..... H05B 33/04
2021/0225297 A1* 7/2021 Shi ..... G09G 3/2092
2021/0233968 A1* 7/2021 Yang ..... G09G 3/3233
2021/0325034 A1* 10/2021 Sakai ..... G06V 40/172
2021/0358394 A1* 11/2021 Yamashita ..... G09G 3/3233
2021/0358401 A1* 11/2021 Liu ..... G09G 3/2003
2022/0223776 A1* 7/2022 Akimoto ..... H01L 27/156

FOREIGN PATENT DOCUMENTS

CN 105913805 8/2016
CN 106531085 3/2017
CN 107705755 2/2018
CN 107818759 3/2018
CN 110246459 9/2019
CN 110288950 9/2019
CN 110853592 2/2020
CN 111341246 6/2020
WO WO 2020/057959 3/2020

* cited by examiner

DISPLAY DEVICE AND LIGHT-EMITTING PANEL

RELATED APPLICATIONS

This application is a National Phase of PCT Patent Application No. PCT/CN2020/132190 having International filing date of Nov. 27, 2020, which claims the benefit of priority of Chinese Patent Application No. 202011222211.1 filed on Nov. 5, 2020. The contents of the above applications are all incorporated by reference as if fully set forth herein in their entirety.

FIELD AND BACKGROUND OF THE INVENTION

The present invention relates to the field of display technology, and more particularly to a display device and a light-emitting panel.

At present, mini light emitting diode (mini LED, sub-millimeter light emitting diode) light-emitting panel or micro light emitting diode (micro LED) light-emitting panel have been widely developed for direct display or as a backlight source of display device.

Existing LED lamp is commonly driven by a driving circuit to drive and emit light. At present, a commonly used driving circuit is 2T1C, that is, a structure of two thin film transistors and a capacitor to convert voltage into current. However, due to factors such as characteristics of the LED lamp, the 2T1C drive circuit can only drive one LED lamp to emit light. Therefore, this setting method increases production cost of the drive circuit.

Therefore, it is necessary to propose a new technical solution to solve the above technical problems.

SUMMARY OF THE INVENTION

An embodiment of the present invention provides a display device and a light-emitting panel, which are configured to reduce the production cost of a driving circuit in the light-emitting panel.

For the above-mentioned objective, the present invention provides a light-emitting panel, comprising a plurality of minimal repeating units, wherein at least two of the minimal repeating units are arranged in an array, the minimal repeating units comprise a driving chip and a light emitting device, and the driving chip and the light emitting device are electrically connected, wherein, the driving chip comprises a first driving submodule, a second driving submodule, and a capacitor, and the light emitting device comprises a first light emitting device and a second light emitting device;

the first driving submodule is electrically connected to a first end of the first light emitting device, and the first driving submodule is configured to access a scan signal and a first data signal, and control the first light emitting device to emit light according to the scan signal and the first data signal;

the second driving submodule is electrically connected to a first end of the second light emitting device, and the second driving submodule is configured to access the scan signal and a second data signal, and control the second light emitting device to emit light according to the scan signal and the second data signal;

a second end of the first light emitting device and a second end of the second light emitting device are both connected to a power supply voltage;

the first driving submodule and the second driving submodule are both connected to a first electrode plate of the capacitor, and a second electrode plate of the capacitor is connected to ground.

The present invention also provides a display device, comprising a liquid crystal box and a backlight module, the liquid crystal box is arranged on the backlight module, and the backlight module includes a backlight source, the backlight source includes a light-emitting panel, the light-emitting panel comprises a plurality of minimal repeating units, wherein at least two of the minimal repeating units are arranged in an array, the minimal repeating units comprise a driving chip and a light emitting device, and the driving chip and the light emitting device are electrically connected, wherein, the driving chip comprises a first driving submodule, a second driving submodule, and a capacitor, and the light emitting device includes a first light emitting device and a second light emitting device;

the first driving submodule is electrically connected to a first end of the first light emitting device, and the first driving submodule is configured to access a scan signal and a first data signal, and control the first light emitting device to emit light according to the scan signal and the first data signal;

the second driving submodule is electrically connected to a first end of the second light emitting device, and the second driving submodule is configured to access the scan signal and a second data signal, and control the second light emitting device to emit light according to the scan signal and the second data signal;

a second end of the first light emitting device and a second end of the second light emitting device are both connected to a power supply voltage;

the first driving submodule and the second driving submodule are both connected to a first electrode plate of the capacitor, and a second electrode plate of the capacitor is connected to ground.

The benefit of the present invention is:

The embodiment of the present invention provides a display device and a light-emitting panel. In the light-emitting panel provided by the embodiment of the present invention, the minimal repeating units comprise the driving chip and the light emitting device, wherein the driving chip comprises at least the first driving submodule and the second driving submodule, and the light emitting device comprises at least the first light emitting device and the second light emitting device, so that the same driving chip can drive at least two light emitting devices to emit light, which reduces the production cost of the driving circuit in the light-emitting panel.

In addition, this arrangement of the driving chip achieves a high degree of integration of the light-emitting panel, and due to the reduction in the number of driving chips, the loss of lamp shadow and brightness is reduced.

DESCRIPTION OF SPECIFIC EMBODIMENTS OF THE INVENTION

Figure 1:
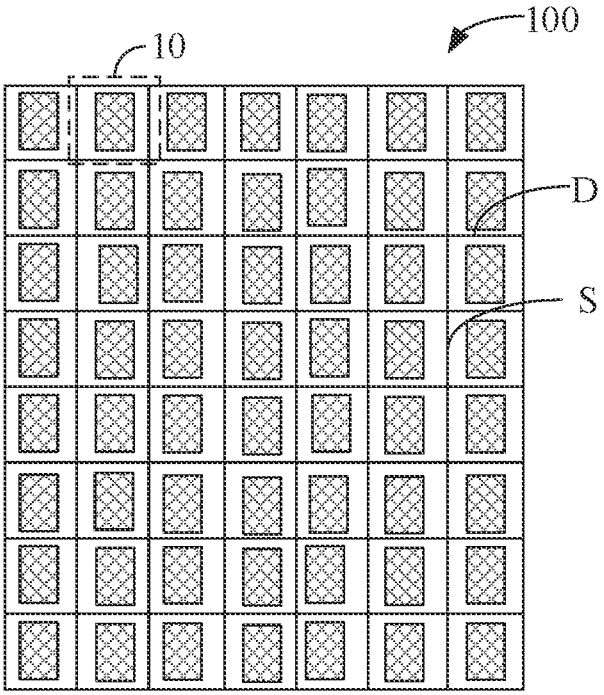
FIG. 1 is a schematic diagram of a light-emitting panel of one embodiment of the present invention.

In order to make the objective, technical solution and advantages of the present invention clearer, the present invention will be further described in detail below with reference to the accompanying drawings. Referring to the figures in the accompanying drawings. The components with the same reference numbers represent the same or similar components. The following description is based on the illustrated specific embodiments of the present disclosure, and should not be construed to limit the other specific embodiments which are not described in detail herein. The word "embodiment" configured in this specification means an example, example, or illustration.

In the description of the present disclosure, it is to be understood that the azimuth or positional relationships indicated by the terms "center", "longitudinal", "transverse", "length", "width", "thickness", "upper", "lower", "front", "back", "left", "right", "vertical", "horizontal", "top", "bottom", "inside", "outside", "clockwise", "counter-clockwise", etc., are based on the azimuth or positional relationship shown in the drawings, merely for the purpose of assisting and simplify the description, rather than indicating or implying that the indicated device or element must have a specific orientation, and be constructed and operated in a particular orientation. Therefore, these terms cannot be construed as limiting the present disclosure. In addition, the terms "first" and "second" are only configured for descriptive purposes, and cannot be understood as indicating or implying relative importance or implicitly indicating the number of indicated technical features. Therefore, the features defined with "first" and "second" may explicitly or implicitly include one or more of the features. In the description of the present application, "a plurality of" means two or more than two, unless otherwise specifically defined.

In the description of the present disclosure, it is to be understood that the terms "installation", "connection" and "connection" should be understood in a broadly understood, unless otherwise specified and defined, for example, as a fixed connection or a removable connection, an integral connection, a mechanical connection, an electrical connection, a communication with each other, a direct connection, an indirect connection via intermediate medium, an internal communication between two elements, or an inter-reaction relationship between two elements. The specific meaning of the above-mentioned terms in the present disclosure may be understood by a person of ordinary skill in the art in light of specific circumstances.

Please refer to FIG. 1, the embodiment of the present invention provides a light-emitting panel, wherein the light-emitting panel 100 comprises a plurality of minimal repeating units 10 formed by crossing data lines D and scan lines S, and at least two of the minimal repeating units 10 are arranged in an array. The light-emitting panel 100 also comprises a film combination (not shown in the figure), which covers the minimal repeating units 10, and which comprises a series of optical film components, such as a quantum film, a prism film, a diffusion film, and a brightness enhancement film.

Figure 2:
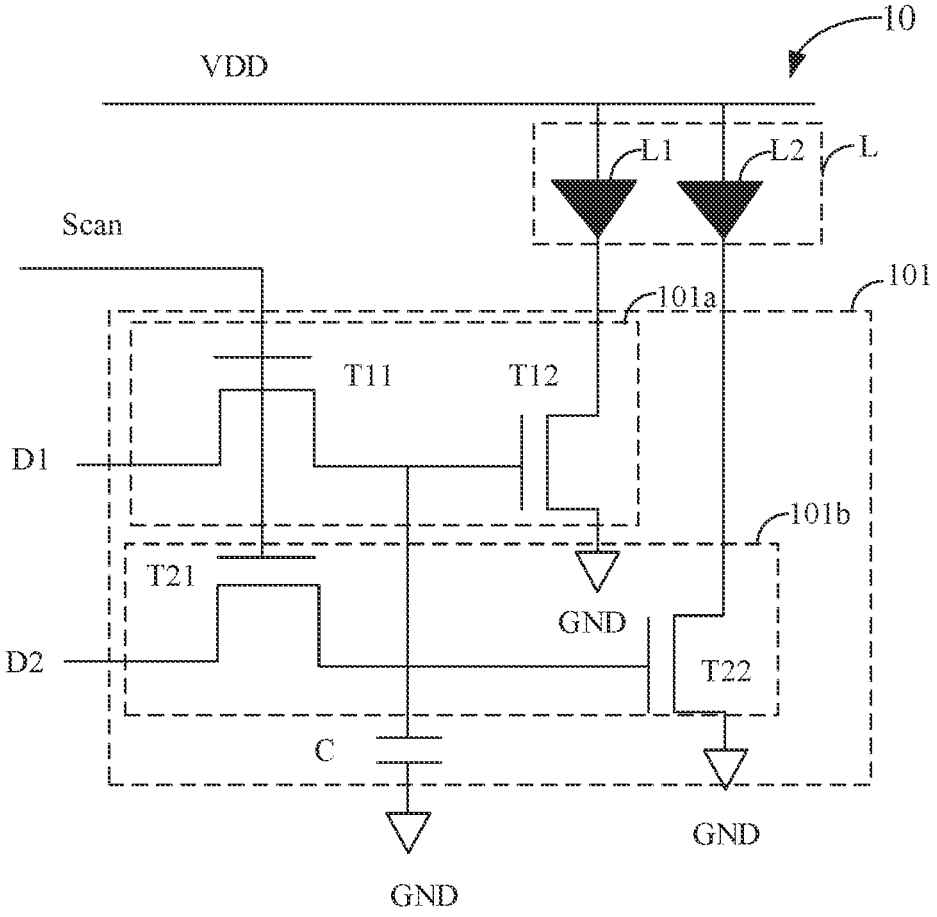
FIG. 2 is a schematic diagram of a minimal repeating unit of the light-emitting panel of one embodiment of the present invention.

Please refer to FIG. 2, the minimal repeating units 10 comprise a driving chip 101 and a light emitting device L, and the driving chip 101 and the light emitting device L are electrically connected. The driving chip 101 comprises a first driving submodule 101*a*, a second driving submodule 101*b*, and a capacitor C, and the light emitting device L comprises a first light emitting device L1 and a second light emitting device L2.

The first driving submodule 101*a* is electrically connected to a first end of the first light emitting device L1, and the first driving submodule 101*a* is configured to access a scan signal SCAN and a first data signal D1, and control the first light emitting device L1 to emit light according to the scan signal SCAN and the first data signal D1.

In some embodiments, the first driving submodule 101*a* comprises a first switching transistor T11 and a first driving transistor T12. Wherein, an output terminal of the first switching transistor T11 is electrically connected to a control terminal of the first driving transistor T12. A control terminal of the first switching transistor T11 is configured to receive the scan signal SCAN. An input terminal of the first switching transistor T11 is configured to receive the first data signal D1. The first switching transistor T11 is configured to output the first data signal D1 to the control terminal of the first driving transistor T12. And an input terminal of the first driving transistor T12 is electrically connected to the first light emitting device L1, and an output terminal of the first driving transistor T12 is connected to the ground GND.

Please continue to refer to FIG. 2, the second driving submodule 101*b* is electrically connected to a first end of the second light emitting device L2. The second driving submodule 101*b* is configured to access the scan signal SCAN and a second data signal D2, and control the second light emitting device L2 to emit light according to the scan signal SCAN and the second data signal D2.

In some embodiments, the second driving submodule 101*b* comprises a second switching transistor T21 and a second driving transistor T22. An output terminal of the second switching transistor T21 is electrically connected to a control terminal of the second driving transistor T22, and a control terminal of the second switching transistor T21 is configured to receive the scan signal SCAN, an input terminal of the second switching transistor T21 is configured to receive the second data signal D2, and the second switching transistor T21 is configured to output the second data signal D2 to the control terminal of the second driving transistor T22. An input terminal of the second driving transistor T22 is electrically connected to the second light emitting device L2, and an output terminal of the second driving transistor T22 is connected to the ground GND.

A second end of the first light emitting device L1 and a second end of the second light emitting device L2 are both connected to the power supply voltage VDD. It should be noted that, in some embodiments, the light emitting device L may be a light emitting diode (LED), wherein the light emitting diode may be a mini light emitting diode (mini LED, sub-millimeter light emitting diode) or a micro light emitting diode (micro LED). When the light emitting device L is a light emitting diode, the first end of the light emitting device L is the cathode of the light emitting diode, and the second end of the light emitting device L is the anode of the light emitting diode.

Please continue to refer to FIG. 2, the first driving submodule 101*a* and the second driving submodule 101*b* are both connected to a first electrode plate of the capacitor C, and a second electrode plate of the capacitor C is connected to the ground GND. Wherein, the capacitor C is a storage capacitor.

Figure 3:
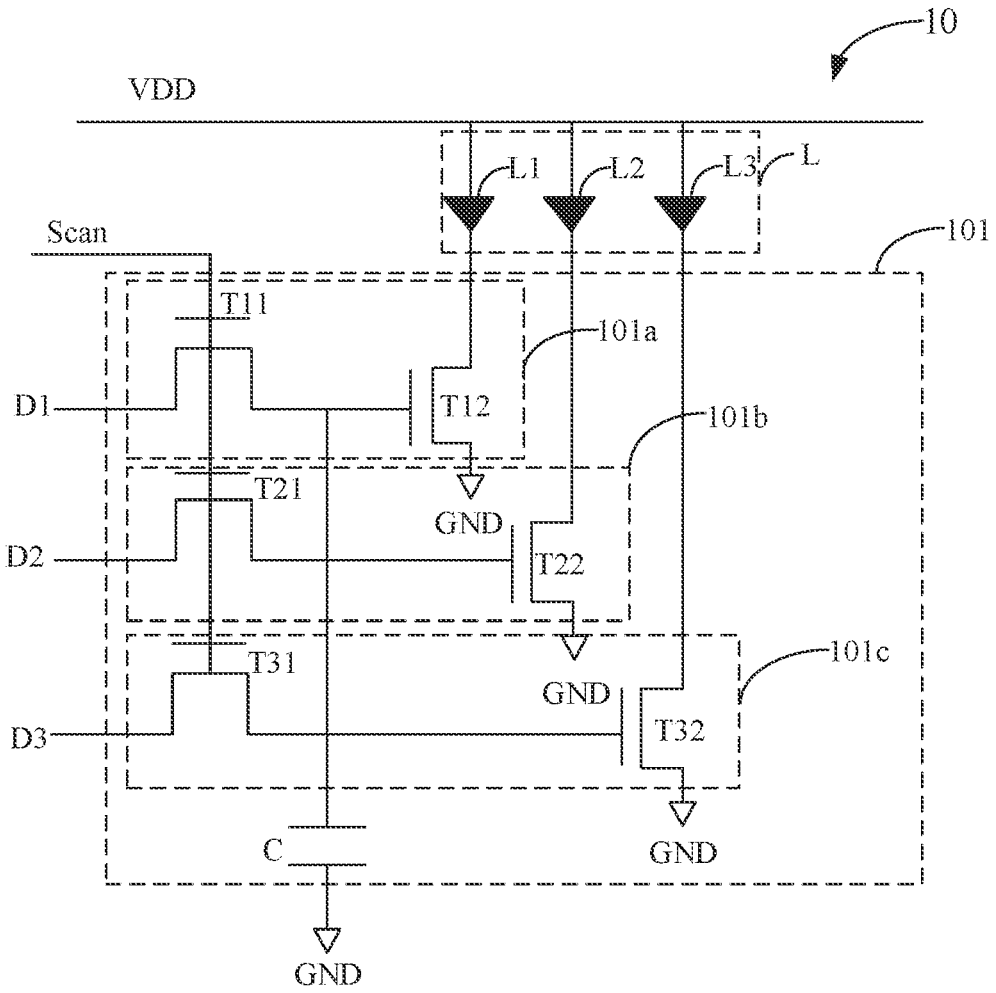
FIG. 3 is another schematic diagram of the minimal repeating unit of the light-emitting panel of one embodiment of the present invention.

Referring to FIG. 3, in some embodiments, the driving chip 101 further comprises a third driving submodule 101*c*, the third driving submodule 101*c* is connected to the first electrode plate of the capacitor C, and the light emitting device L further comprises a third light emitting device L3. Wherein, the third driving submodule 101*c* is electrically connected to a first end of the third light emitting device L3, and the third driving submodule 101*c* is configured to receive the scan signal SCAN and a third data signal D3, and control the third light emitting device L3 to emit light according to the scan signal SCAN and the third data signal D3. A second end of the third light emitting device L3 is connected to the power supply voltage VDD.

Specifically, in some embodiments, the third driving submodule 101*c* comprises a third switching transistor T31 and a third driving transistor T32. An output terminal of the third switching transistor T31 is electrically connected to a control terminal of the third driving transistor T32, and a control terminal of the third switching transistor T31 is configured to receive the scan signal SCAN, and an input terminal of the third switching transistor T31 is configured to receive the third data signal D3, and the third switching transistor T31 is configured to output the third data signal D3 to the control terminal of the third driving transistor T32. An input terminal of the third driving transistor T32 is electrically connected to the third light emitting device L3, and an output terminal of the third driving transistor T32 is connected to the ground GND.

Figure 4:
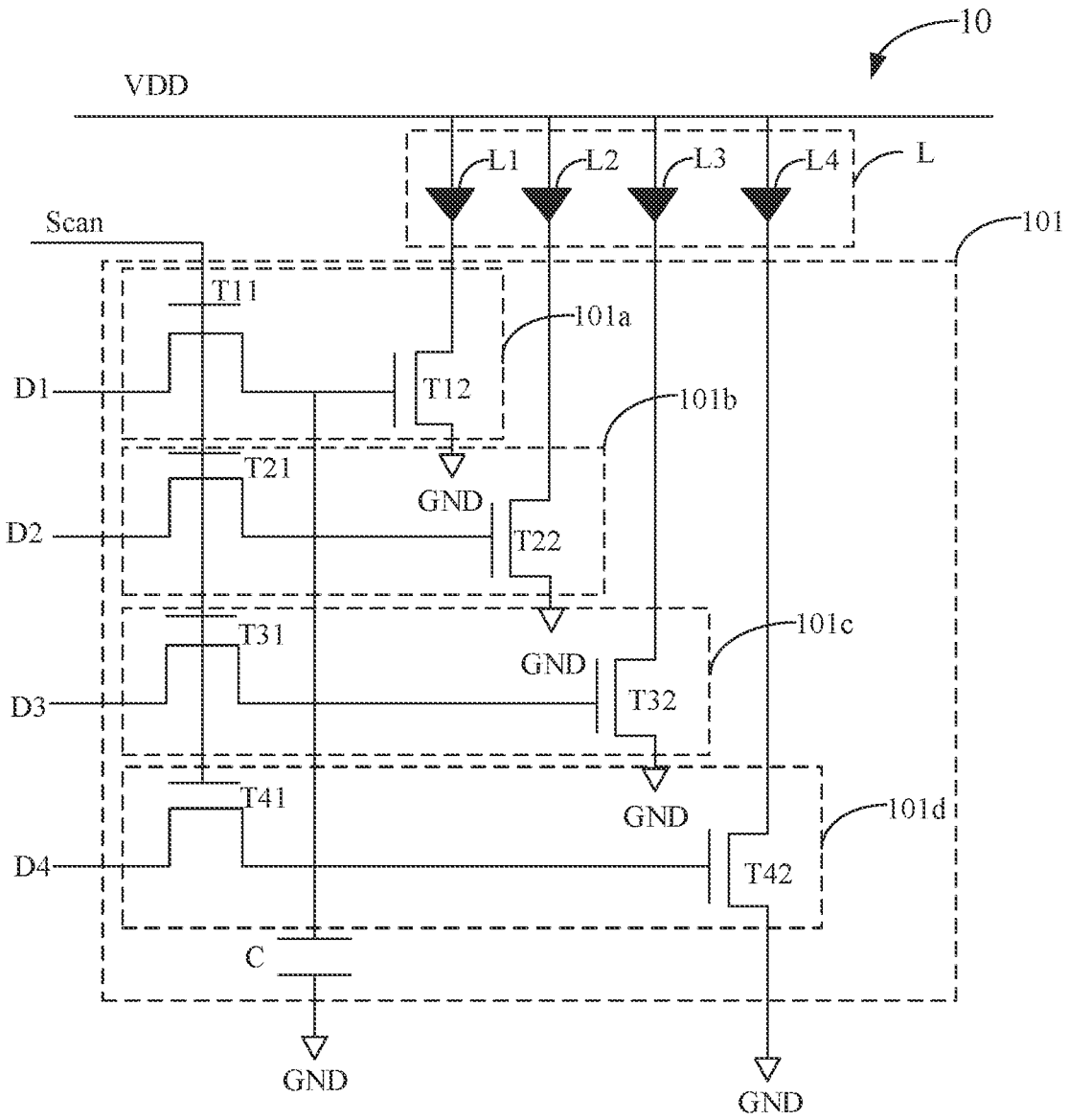
FIG. 4 is yet another schematic diagram of the minimal repeating unit of the light-emitting panel of one embodiment of the present invention.

Please refer to FIG. 4, in some embodiments, the driving chip 101 further comprises a fourth driving submodule 101*d*, the fourth driving submodule 101*d* is connected to the first electrode plate of the capacitor C, and the light emitting device L further comprises a fourth light emitting device L4. The fourth driving submodule 101*d* is electrically connected to a first end of the fourth light emitting device L4, and the fourth driving submodule 101*d* is connected to the scan signal SCAN and a fourth data signal D4, and control the fourth light emitting device L4 to emit light according to the scan signal SCAN and the fourth data signal D4. A second end of the fourth light emitting device L4 is connected to the power supply voltage VDD.

In some embodiments, the fourth driving submodule 101*d* comprises a fourth switching transistor T41 and a fourth driving transistor T42. An output terminal of the fourth switching transistor T41 is electrically connected to a control terminal of the fourth driving transistor T42, a control terminal of the fourth switching transistor T41 is configured to receive the scan signal SCAN, and an input terminal of the fourth switching transistor T41 is configured to receive the fourth data signal D4, and the fourth switching transistor T41 is configured to output the fourth data signal D4 to the control terminal of the fourth driving transistor T42. An input terminal of the fourth driving transistor T42 is electrically connected to the fourth light emitting device L4, and an output terminal of the fourth driving transistor T42 is connected to the ground GND.

Figure 5:
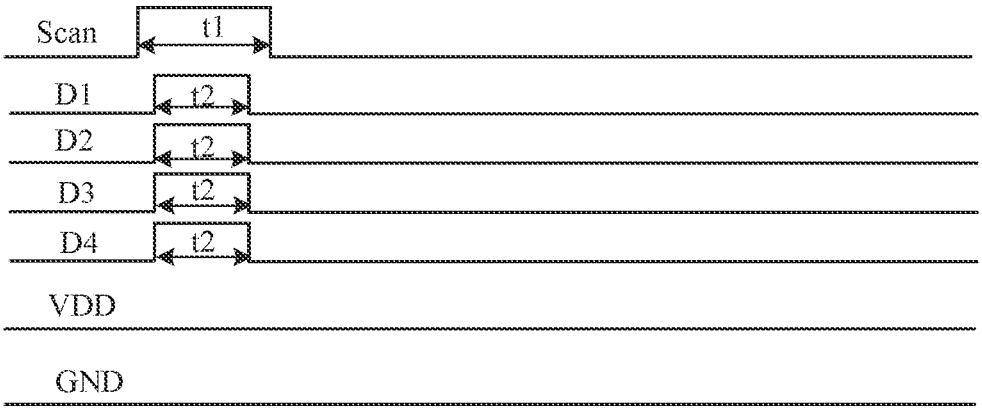
FIG. 5 is a signal timing diagram of the light-emitting panel of one embodiment of the present invention.

Further, please refer to FIG. 5, which is a signal timing diagram of the driving chip provided by the embodiment of the present invention. When the scan signal SCAN is at a high level potential, and the first data signal D1 and/or the second data signal D2 is at a high level potential.

Specifically, at the stage where a threshold voltage is compensated, the scan signal SCAN is at a high level potential, and the first data signal D1 and/or the second data signal D2 is at a high level potential, so that the first switching transistor T11 and/or the second switching transistor T21 is in an on state. Wherein, the first data signal D1 and/or the second data signal D2 passes through the output terminal of the first switching transistor T11 and/or the second switching transistor T21, and is transmitted to the control terminal of the first driving transistor T12 and/or the second driving transistor T22, so as to control turning on of the first driving transistor T12 and/or the second driving transistor T22, that makes the first light emitting device L1 and/or the second light emitting device L2 emit light.

In some embodiments, the third data signal D3 and the fourth data signal D4 have the same signal timing diagram as the first data signal D1 and the second data signal D2. That is, at the stage where a threshold voltage is compensated, the scan signal SCAN is at a high level potential, and the third data signal D3 and/or the fourth data signal D4 is at a high level potential, so that the third switching transistor T31 and/or the fourth switching transistor T41 is in an on state. Wherein, the third data signal D3 and/or the fourth data signal D4 passes through the output terminal of the third switching transistor T31 and/or the fourth switching transistor, and is transmitted to the control terminal of the third driving transistor T32 and/or the fourth driving transistor T42, so as to control turning on of the third driving transistor T32 and/or the fourth driving transistor T42, that makes the third light emitting device L3 and/or the fourth light emitting device L4 emit light.

At the stage where the threshold voltage is compensated and the light emitting stage, the power supply voltage VDD is a constant high voltage, and the voltage of the ground GND is zero volt.

Further, please continue to refer to FIG. 5, a time t1 during which the scan signal SCAN is at a high level potential is greater than or equal to a time t2 during which the first data signal D1 and/or the second data signal D2 is at a high level potential. Specifically, a time of a rising edge of the scan signal SCAN from a low level potential to a high level potential is earlier than a time of the rising edge of the first data signal D1 and/or the second data signal D2 from a low level potential to a high level potential. And, a time of a falling edge of the scan signal SCAN from the high level potential to the low level potential later than a time of the falling edge of the first data signal D1 and/or the second data signal D2 from a low level potential to a high level potential.

In some embodiments, a time of a rising edge of the scan signal SCAN from a low level potential to a high level potential is earlier than a time of the rising edge of the third data signal D3 and/or the fourth data signal D4 from a low level potential to a high level potential. And, a time of a falling edge of the scan signal SCAN from the high level potential to the low level potential later than a time of the falling edge of the third data signal D3 and/or the fourth data signal D4 from a low level potential to a high level potential.

In some embodiments, the first switching transistor T11, the first driving transistor T12, the second switching transistor T21, the second driving transistor T22, the third switching transistor T31, the third driving transistor T32, the fourth switching transistor T41, and the fourth driving transistor T42 may be a low-temperature polysilicon thin film transistor, an oxide semiconductor thin film transistor, or an amorphous silicon thin film transistor.

Figure 6:
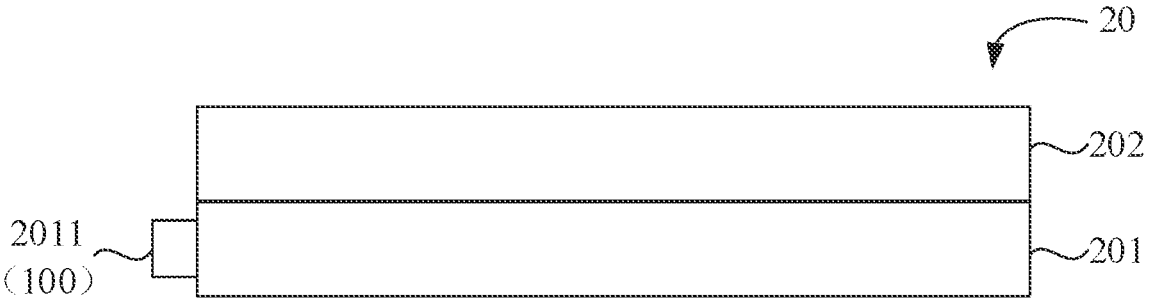
FIG. 6 is a schematic diagram of a display device of one embodiment of the present invention.

Referring to FIG. 6, the embodiment of the present invention also provides a display device 20. The display device 20 comprises a liquid crystal box 202 and a backlight module 201. The liquid crystal box 202 is disposed on the backlight module 201. Wherein, the backlight module 201 comprises a backlight source 2011, and the backlight source 2011 is the light-emitting panel 100 of any one of the above embodiments. It should be noted that the backlight source 2011 in this embodiment may be a direct type backlight source or an edge type backlight source, which is not limited herein.

The light-emitting panel 100 in the embodiment of the present invention can be configured to display directly, and can also be configured as a backlight source in a display device. When the light-emitting panel 100 is configured to display directly, for example, the light-emitting panel 100 may be configured as an LED TV.

The embodiment of the present invention provides a display device and a light-emitting panel. In the light-emitting panel provided by the embodiment of the present invention, the minimal repeating units comprise the driving chip and the light emitting device, wherein the driving chip comprises at least the first driving submodule and the second driving submodule, and the light emitting device comprises at least the first light emitting device and the second light emitting device, so that the same driving chip can drive at least two light emitting devices to emit light, which reduces the production cost of the driving circuit in the light-emitting panel.

In addition, this arrangement of the driving chip achieves a high degree of integration of the light-emitting panel, and due to the reduction in the number of driving chips, the loss of lamp shadow and brightness is reduced.

In summary, although the present invention has been disclosed in preferred embodiments as above, the above-mentioned preferred embodiments are not intended to limit the present invention. Those of ordinary skill in the art can make various modifications without departing from the spirit and scope of the present invention. Such changes and modifications, therefore, the protection scope of the present invention is subject to the scope defined by the claims.

What is claimed is:

1. A light-emitting panel, comprising a plurality of minimal repeating units, wherein at least two of the minimal repeating units are arranged in an array, each of the minimal repeating units comprises a driving chip and a light emitting device, and the driving chip and the light emitting device are electrically connected, wherein the driving chip comprises a first driving submodule, a second driving submodule, a third driving submodule, a fourth driving submodule, and a capacitor, and the light emitting device comprises a first light emitting device, a second light emitting device, a third light emitting device, and a fourth light emitting device;

the first driving submodule is electrically connected to a first end of the first light emitting device, and the first driving submodule is configured to access a scan signal and a first data signal, and control the first light emitting device to emit light according to the scan signal and the first data signal;

the second driving submodule is electrically connected to a first end of the second light emitting device, and the second driving submodule is configured to access the scan signal and a second data signal, and control the second light emitting device to emit light according to the scan signal and the second data signal;

a second end of the first light emitting device and a second end of the second light emitting device are both connected to a power supply voltage;

the first driving submodule, the second driving submodule, the third driving submodule, and the fourth driving submodule are all connected to a first electrode plate of the capacitor, and a second electrode plate of the capacitor is connected to ground; and the driving chip is configured to drive the first light emitting device, the second light emitting device, the third light emitting device, and the fourth light emitting device to emit light;

wherein the first driving submodule comprises a first switching transistor and a first driving transistor, the second driving submodule comprises a second switching transistor and a second driving transistor, the third driving submodule comprises a third switching transistor and a third driving transistor, the fourth driving submodule comprises a fourth switching transistor and a fourth driving transistor, the third driving submodule is configured to receive the scan signal and a third data signal, and the fourth driving submodule is configured to receive the scan signal and a fourth data signal;

wherein at a stage where a threshold voltage is compensated, the scan signal is at a high level potential, and the first data signal and the second data signal are at the high level potential, so that the first switching transistor and the second switching transistor are in an on state, the third data signal and the fourth data signal are at the high level potential, so that the third switching transistor and the fourth switching transistor are in the on state, and the third data signal and the fourth data signal have the same signal timing diagram as the first data signal and the second data signal.

2. The light-emitting panel according to claim 1, wherein:

an output terminal of the first switching transistor is electrically connected to a control terminal of the first driving transistor, a control terminal of the first switching transistor is configured to receive the scan signal, and an input terminal of the first switching transistor is configured to receive the first data signal, the first switching transistor is configured to output the first data signal to the control terminal of the first driving transistor; and an input terminal of the first driving transistor is electrically connected to the first light emitting device, and an output terminal of the first driving transistor is connected to the ground.

3. The light-emitting panel according to claim 2, wherein;

an output terminal of the second switching transistor is electrically connected to a control terminal of the second driving transistor, a control terminal of the second switching transistor is configured to receive the scan signal, and an input terminal of the second switching transistor is configured to receive the second data signal, and the second switching transistor is configured to output the second data signal to the control terminal of the second driving transistor; and an input terminal of the second driving transistor is electrically connected to the second light emitting device, and an output terminal of the second driving transistor is connected to the ground.

4. The light-emitting panel according to claim 1, wherein the third driving submodule is electrically connected to a first end of the third light emitting device, and control the third light emitting device to emit light according to the scan signal and the third data signal; and a second end of the third light emitting device is connected to the power supply voltage.

5. The light-emitting panel according to claim 4, wherein:

an output terminal of the third switching transistor is electrically connected to a control terminal of the third driving transistor, a control terminal of the third switching transistor is configured to receive the scan signal, and an input terminal of the third switching transistor is configured to receive the third data signal, and the third switching transistor is configured to output the third data signal to the control terminal of the third driving transistor; and an input terminal of the third driving transistor is electrically connected to the third light emitting device, and an output terminal of the third driving transistor is connected to the ground.

6. The light-emitting panel according to claim 4, wherein the fourth driving submodule is electrically connected to a first end of the fourth light emitting device, and control the fourth light emitting device to emit light according to the scan signal and the fourth data signal; and a second end of the fourth light emitting device is connected to the power supply voltage.

7. The light-emitting panel according to claim 6, wherein:

an output terminal of the fourth switching transistor is electrically connected to a control terminal of the fourth driving transistor, a control terminal of the fourth switching transistor is configured to receive the scan signal, and an input terminal of the fourth switching transistor is configured to receive the fourth data signal, and the fourth switching transistor is configured to output the fourth data signal to the control terminal of the fourth driving transistor; and an input terminal of the fourth driving transistor is electrically connected to the fourth light emitting device, and an output terminal of the fourth driving transistor is connected to the ground.

8. The light-emitting panel according to claim 6, wherein when the scan signal is at a high level potential, the third data signal and/or the fourth data signal is at the high level potential.

9. The light-emitting panel according to claim 1, wherein when the scan signal is at a high level potential, the first data signal and/or the second data signal is at the high level potential.

10. The light-emitting panel according to claim 9, wherein a time during which the scan signal is at the high level potential is greater than or equal to a time during which the first data signal and/or the second data signal is at the high level potential.

11. A display device, comprising a liquid crystal box and a backlight module, wherein the liquid crystal box is arranged on the backlight module, and the backlight module includes a backlight source, the backlight source includes a light-emitting panel, the light-emitting panel comprises a plurality of minimal repeating units, wherein at least two of the minimal repeating units are arranged in an array, each of the minimal repeating units comprises a driving chip and a light emitting device, and the driving chip and the light emitting device are electrically connected, wherein the driving chip comprises a first driving submodule, a second driving submodule, a third driving submodule, a fourth driving submodule, and a capacitor, and the light emitting device comprises a first light emitting device, a second light emitting device, a third light emitting device, and a fourth light emitting device;

the first driving submodule is electrically connected to a first end of the first light emitting device, and the first driving submodule is configured to access a scan signal and a first data signal, and control the first light emitting device to emit light according to the scan signal and the first data signal, the second driving submodule is electrically connected to a first end of the second light emitting device, and the second driving submodule is configured to access the scan signal and a second data signal, and control the second light emitting device to emit light according to the scan signal and the second data signal;

a second end of the first light emitting device and a second end of the second light emitting device are both connected to a power supply voltage;

the first driving submodule, the second driving submodule, the third driving submodule, and the fourth driving submodule are all connected to a first electrode plate of the capacitor, and a second electrode plate of the capacitor is connected to ground; and the driving chip is configured to drive the first light emitting device, the second light emitting device, the third light emitting device, and the fourth light emitting device to emit light;

wherein the first driving submodule comprises a first switching transistor and a first driving transistor, the second driving submodule comprises a second switching transistor and a second driving transistor, the third driving submodule comprises a third switching transistor and a third driving transistor, the fourth driving submodule comprises a fourth switching transistor and a fourth driving transistor, the third driving submodule is configured to receive the scan signal and a third data signal, and the fourth driving submodule is configured to receive the scan signal and a fourth data signal;

wherein at a stage where a threshold voltage is compensated, the scan signal is at a high level potential, and the first data signal and the second data signal are at the high level potential, so that the first switching transistor and the second switching transistor are in an on state, the third data signal and the fourth data signal are at the high level potential, so that the third switching transistor and the fourth switching transistor are in the on state, and the third data signal and the fourth data signal have the same signal timing diagram as the first data signal and the second data signal.

12. The display device according to claim 11, wherein:

an output terminal of the first switching transistor is electrically connected to a control terminal of the first driving transistor, a control terminal of the first switching transistor is configured to receive the scan signal, and an input terminal of the first switching transistor is configured to receive the first data signal, the first switching transistor is configured to output the first data signal to the control terminal of the first driving transistor; and an input terminal of the first driving transistor is electrically connected to the first light emitting device, and an output terminal of the first driving transistor is connected to the ground.

13. The display device according to claim 12, wherein:

an output terminal of the second switching transistor is electrically connected to a control terminal of the second driving transistor, a control terminal of the second switching transistor is configured to receive the scan signal, and an input terminal of the second switching transistor is configured to receive the second data signal, and the second switching transistor is configured to output the second data signal to the control terminal of the second driving transistor; and an input terminal of the second driving transistor is electrically connected to the second light emitting device, and an output terminal of the second driving transistor is connected to the ground.

14. The display device according to claim 11, wherein the third driving submodule is electrically connected to a first end of the third light emitting device, and control the third light emitting device to emit light according to the scan signal and the third data signal; and a second end of the third light emitting device is connected to the power supply voltage.

15. The display device according to claim 14, wherein:

an output terminal of the third switching transistor is electrically connected to a control terminal of the third driving transistor, a control terminal of the third switching transistor is configured to receive the scan signal, and an input terminal of the third switching transistor is configured to receive the third data signal, and the third switching transistor is configured to output the third data signal to the control terminal of the third driving transistor; and an input terminal of the third driving transistor is electrically connected to the third light emitting device, and an output terminal of the third driving transistor is connected to the ground.

16. The display device according to claim 14, wherein the fourth driving submodule is electrically connected to a first end of the fourth light emitting device, and control the fourth light emitting device to emit light according to the scan signal and the fourth data signal; and a second end of the fourth light emitting device is connected to the power supply voltage.

17. The display device according to claim 16, wherein:

an output terminal of the fourth switching transistor is electrically connected to a control terminal of the fourth driving transistor, a control terminal of the fourth switching transistor is configured to receive the scan signal, and an input terminal of the fourth switching transistor is configured to receive the fourth data signal, and the fourth switching transistor is configured to output the fourth data signal to the control terminal of the fourth driving transistor; and an input terminal of the fourth driving transistor is electrically connected to the fourth light emitting device, and an output terminal of the fourth driving transistor is connected to the ground.

18. The display device according to claim 16, wherein when the scan signal is at a high level potential, the third data signal and/or the fourth data signal is at the high level potential.

19. The display device according to claim 11, wherein when the scan signal is at a high level potential, the first data signal and/or the second data signal is at the high level potential.

20. The display device according to claim 19, wherein a time during which the scan signal is at the high level potential is greater than or equal to a time during which the first data signal and/or the second data signal is at the high level potential.

* * * * *